United States Patent [19]

Sakono et al.

[11] Patent Number: 4,907,551

[45] Date of Patent: Mar. 13, 1990

[54] V-TYPE ENGINE

[75] Inventors: Takashi Sakono; Yasushi Inoue; Shigeki Nakatani, all of Hiroshima, Japan

[73] Assignee: Mazda Motor Corporation, Hiroshima, Japan

[21] Appl. No.: 344,991

[22] Filed: Apr. 28, 1989

[30] Foreign Application Priority Data

Apr. 30, 1988 [JP] Japan ..... 63-108436
Jun. 15, 1988 [JP] Japan ..... 63-147566

[51] Int. Cl.[4] ..... F01M 1/00
[52] U.S. Cl. ..... 123/196 R; 123/55 VS
[58] Field of Search ..... 123/196 R, 55 VS, 55 VF, 123/55 VE, 55 V

[56] References Cited

U.S. PATENT DOCUMENTS

| | | | |
|---|---|---|---|
| 2,907,411 | 10/1959 | Leach | 123/196 R |
| 3,014,554 | 12/1961 | Etchells et al. | 123/196 R |
| 4,494,494 | 1/1985 | Yahiro et al. | 123/55 VS |
| 4,589,382 | 5/1986 | Tsuboi | 123/196 R |
| 4,729,349 | 3/1988 | Sonoda et al. | 123/90.34 |

*Primary Examiner*—E. Rollins Cross
*Attorney, Agent, or Firm*—Wegner & Bretschneider

[57] ABSTRACT

A V-shaped cylinder block for a V-type engine includes a main oil gallery elongating in an axial direction of a crank shaft; a subordinate oil gallery elongating in the axial direction thereof; a linkage passage interconnecting the main oil gallery to the subordinate oil gallery; a first feed passage feeding oil from the subordinate oil gallery to a predetermined crank journaling portion disposed at least on one side of the cylinder block in the axial direction thereof without passing through the main oil gallery; a second feed passage feeding a lubricating oil from the main oil gallery to the crank journaling portions other than the predetermined crank journaling portion; and a pump chamber having a rotary shaft disposed in parallel to the crank shaft. The main oil gallery disposed in a middle portion between the left-hand and the right-hand banks and at a position above the crank chamber, the main oil gallery being in a length elongating in the axial direction thereof and failing to reach the predetermined crank journaling portion. The subordinate oil gallery is disposed on an outer side portion of the left-hand and right-hand banks. The pump chamber is disposed at one end portion of the cylinder block in the axial direction thereof and formed on an imaginary line extending from the main oil gallery.

19 Claims, 10 Drawing Sheets

V-TYPE ENGINE

BACKGROUND OF THE INVENTION

1. Field of the Invention

The present invention relates to an improvement in a V-type engine.

2. Description of Related Art

Recently, there has been the growing tendency that V-type engines are loaded on many vehicle models because they have the characteristic that their engine is in a short full length. Furthermore, in order to reduce the weight of an engine, there is the tendency that at least a cylinder block is made from a light alloy containing aluminium or the like.

It is essential that a lubricating apparatus for the V-type engines does not impair a compact construction as a V-type engine. When oil passages are formed in the cylinder block made by die casting a light alloy with drills, a leakage of oil may cause a big problem so that they should be formed by withdrawing dies.

U.S. Pat. No. 4,494,494 and Japanese Utility Model Application Laid-Open No. 147,706/1985 disclose a lubricating apparatus for a V-type engine, in which a pair of right-hand and left-hand banks are disposed in a V-shaped form and a main oil gallery is disposed at a middle portion of the cylinder block at a position above a crank shaft between the banks. This presents the greater advantage from the structural point of view compared with the oil gallery disposed on a side portion of each of the banks. When the main oil gallery is disposed at the middle portion of the cylinder block, lubricating oil is supplied to a crank journaling portion through the main oil gallery. In this case, however, a plurality of the crank journaling portions should be disposed in a spaced relationship in an axial direction of the crank shaft so that a full length in which the plural crank journaling portions are formed ranges from one end portion to the other of the cylinder block, thus requiring the main oil gallery, too, to elongate over a full length in a lengthwise direction of the cylinder block.

In many cases, the cylinder block of the v-type engines contains a pump chamber. For example, a water-cooling type engine is provided with a water pump for supplying cooling water under pressures around the cylinder bores. For the V-type engine, it is preferred to form a pump chamber of the water pump at a middle portion between the right-hand and left-hand banks in order to allow an equal distribution of cooling water therebetween. It is also preferred to dispose the water pump at a position as low as possible to avoid exposure of an impeller to air at the time of reduction in water.

However, the disposition of a pump and related elements of the water pump at a low position presents the difficulty that the pump chamber to be disposed in the cylinder block interferes with the main oil gallery on one side of the cylinder block in an axial direction of the crank shaft. Accordingly, the pump has been heretofore disposed on one end portion in a center space of the V-shaped banks or offset toward the left-hand or right-hand side from the center portion in order to avoid an interference with the main oil gallery. The former case, however, suffers from the disadvantage that the impeller is caused to be exposed to air at the time when water is reduced, thus accelerating deterioration of the pump, or that the pump chamber cannot be formed in the cylinder block, thus making a full engine length longer.

In the latter case, for example, the problem may arise such that it is difficult to equally distribute cooling water between the right-hand and right-hand banks.

Recently, a knock sensor for sensing a knocking of the engine is generally provided on the cylinder block of the engine. For V-type engines, a knock sensor is provided on the cylinder block. For example, Japanese Patent Application Laid-Open No. 101,839/1987 discloses a knock sensor which is mounted at a center portion of a rib disposed on the cylinder block at a substantially middle portion in an axial direction of the crank shaft so as to connect the right-hand bank to the light-hand bank. An additional disposition of the rib, however, presents the disadvantages in terms of cost and structure.

SUMMARY OF THE INVENTION

Therefore, the present invention has the first object to provide a V-type engine adapted to form a main oil gallery and a pump chamber in the cylinder block at positions preferable for the V-type engine.

The present invention has the second object to provide a V-type engine adapted to mount a knock sensor at a preferred position of the cylinder block without a requirement for a additional disposition of the rib for exclusive use in mounting the knock sensor.

In order to achieve the first object, the present invention consists of a V-type engine in which a cylinder block comprises a left-hand bank and right-hand bank, said left-hand and right-hand banks being arranged in a V-shaped form and having each a cylinder bore, and a crank chamber on which a lower end of each cylinder bore has opening; and in which a crank shaft mounted in said crank chamber is rotatably supported by plural crank journaling portions arranged in said cylinder block in a spaced relationship in an axial direction of the crank shaft; in which:

said cylinder block includes a main oil gallery elongating in the axial direction of said crank shaft; a subordinate oil gallery elongating in said axial direction; a first feed passage feeding oil from said subordinate oil gallery to a predetermined crank journaling portion disposed at least on a side of one end portion of said cylinder block disposed in said axial direction, among said plural crank journaling portions, without passing through said main oil gallery; a second feed passage feeding a lubricating oil from said main oil gallery to said crank journaling portions other than said predetermined crank journaling portion; and a pump chamber having a rotary shaft disposed in parallel to said crank shaft;

a linkage passage interconnecting said main oil gallery to said subordinate oil gallery;

said main oil gallery is disposed in a middle portion between said banks and at a position above said crank chamber, a top end of said main oil gallery being in a length elongating in said axial direction so as to fail to reach said predetermined crank journaling portion;

said subordinate oil gallery is disposed on one outward side portions of said banks; and said pump chamber is disposed at one end portion of said cylinder block in said axial direction and on an imaginary line extending from said main oil gallery.

In order to achieve the second object, the present invention consists of a V-type engine in which a a cylinder block comprises a left-hand bank and a right-hand bank, said left-hand and right-hand banks being arranged in a V-shaped form and having each a cylinder bore, and a crank chamber on which a lower end of each cylinder bore has opening; and in which a crank shaft mounted in said crank chamber is rotatably supported by plural crank journaling portions arranged in said cylinder block in a spaced relationship in an axial direction of the crank shaft; in which:

said cylinder block is formed by casting;

said cylinder block is provided with a die-withdrawing hole extending in said axial direction is formed at a position disposed between said banks;

a boss portion formed on said cylinder block in a shape corresponding to a support jig supporting said pin-like jig for said die-withdrawing hole from outward during casting; and a mounting seat disposed on said boss portion for mounting a knock sensor.

BRIEF DESCRIPTION OF THE DRAWINGS

Other objects, features and advantages of the present invention will become apparent in the course of the description of the preferred embodiments in the light of the drawings, in which.

DESCRIPTION OF THE PREFERRED EMBODIMENTS

The present invention will be described by way of examples in conjunction with the accompanying drawings.

Figure 1:
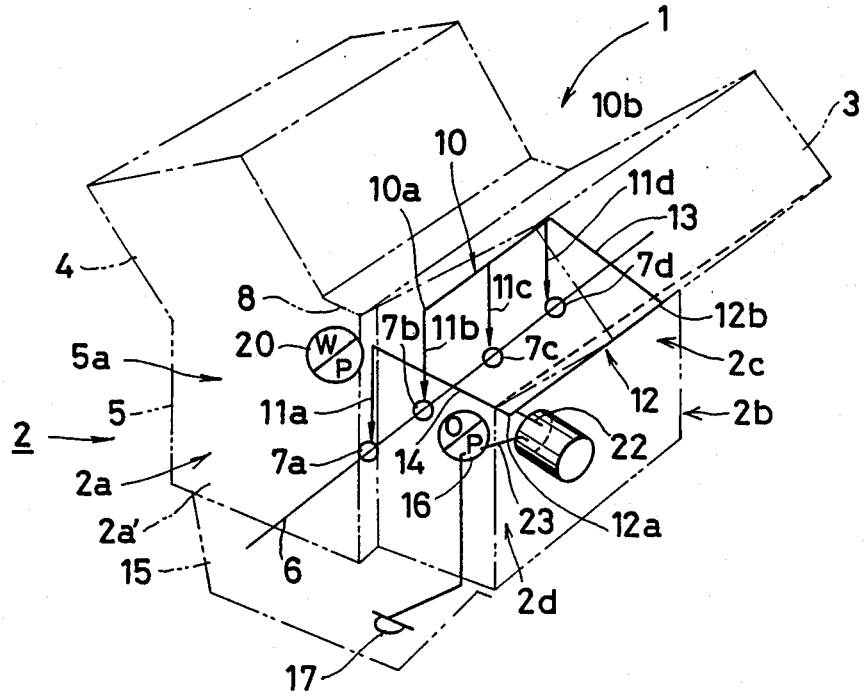
FIG. 1 is a schematical representation showing a concept of the structure of a V-type engine according to the present invention.

Referring to FIG. 1, a V-type engine 1 is shown to comprise a cylinder block 2 with a pair of right-hand and left-hand banks 3 and 4 disposed in a V-shaped form, respectively. In this embodiment, the cylinder block 2 is shown to be of the 6 -cylinder type so that the right-hand and left-hand banks 3 and 4 are provided each with three cylinder bores 31*b*, 31*d*, and 31*f* as well as 31*a*, 31*c*, and 31*e*, respectively, as shown specifically in FIG. 3. The cylinder block 2 further comprises a skirt portion 5 as a crank casing structuring element, crank journaling portions (bearing portions), generally referred to as 7, of a crank shaft 6, and a crank chamber 5*a* disposed in an inner space of the skirt portion 5.

The cylinder block 2 of the V-type six-cylinder engine is provided with four crank journaling portions 7 from one end 2*a* to the other end 2*b* in an axial direction of the crank shaft 6, namely, first, second, third and fourth crank journaling portions 7*a*, 7*b*, 7*c* and 7*d*, respectively.

The cylinder block 2 is provided with a main oil gallery 10 at an intermediate portion between the right-hand and left-hand banks 3 and 4 and at a middle portion 8 of the cylinder block 2 at a position above the crank chamber 5*a*. The main oil gallery 10 is disposed right above the crank journaling portions 7 and elongates from the second crank journaling portion 7*b* to the other end 2*b* in the axial direction of the crank shaft 6. In other words, the main oil gallery 10 extends in a length up to a position above the second crank journaling portion 7*b* and one end 10*a* of the main oil gallery 10 is designed to fail to reach a position above the first crank journaling portion 7*a*, as shown specifically in FIG. 2. The main oil gallery 10 is communicated with the second, third and fourth crank journaling portions 7*b*, 7*c*, and 7*d*, through a second feed passage 11*b*, 11*c*, and 11*d*, respectively, each extending in a vertical direction. The cylinder block 2 is further provided at its one side portion 2*c*, on the one hand, with a subordinate oil gallery 12 which elongates from the one end portion 2*a* to the other end portion 2*b* of the cylinder block 2 in the axial direction of the crank shaft 6 and the other end 12*b* of the subordinate oil gallery 12 is connected to the other end 10*b* of the main oil gallery 10 through a linkage passage 13 disposed in the other end portion 2*b* of the cylinder block 2.

To the first crank journaling portion 7*a* disposed on the one end portion 2*a* of the cylinder block 2 is fed lubricating oil through a vertical passage 11*a* elongating vertically from the first journaling portion 7*a*, and the vertical passage 11*a* is connected to the one end 12*a* of the subordinate oil gallery 12 through a transverse passage 14 formed in the one end portion 2*a* of the cylinder block 2. The vertical passage 11*a* and the transverse passage 14 comprise a first feed passage.

To the subordinate oil gallery 12 is fed oil by pumping the oil stored in an oil pan 15 through an oil strainer 17 by an oil pump 16 and filtering it through an oil filter 18. The oil filter 18 is mountable on a side surface 2*d* of the cylinder block 2 at the one side portion 2*a* thereof, and a pump chamber of the oil pump 16 is disposed in a vicinity of the oil filter 18 at a side surface 2*a* of the cylinder block 2.

At the one side surface 2*a* of the cylinder block 2 is disposed a pump chamber 20 of the water pump at the middle portion 8 of the cylinder block 2, and the pump chamber 8 applies pressures to a cooling water for the engine and supplies it through a cooling water passage (not shown) to the right-hand and left-hand banks 3 and 4.

Figure 2:
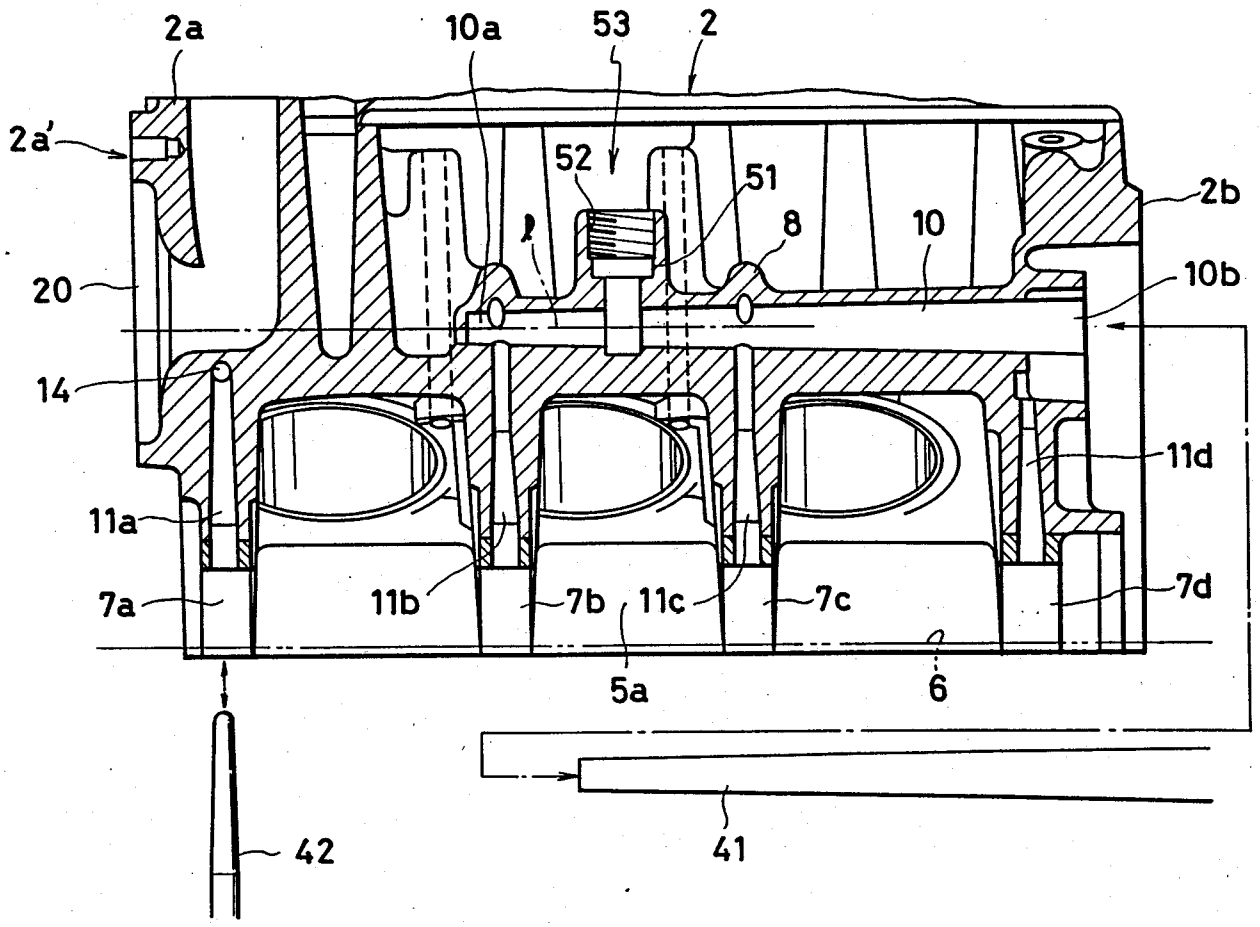
FIG. 2 is a cross-sectional view showing a cylinder block taken along the line X2—X2 of FIG. 5.

Detail of the cylinder block 2 will be described in conjunction with FIG. 2 and following drawings.

Figure 11:
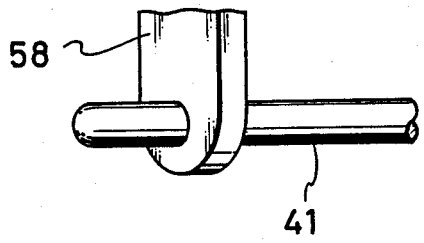
FIG. 11 is a perspective view showing a state in which a pin-like jig for forming a main oil gallery is engaged with a support jig for supporting the pin-like jig.

The cylinder block 2 may be made from a light alloy such as aluminium and formed by the die cast method. The main oil gallery 10 and the other oil passages are formed by the die-withdrawing method. More specifically, the main oil gallery 10 is formed as a die-withdrawing hole by withdrawing a pin-like jig 41 (as shown in FIGS. 2 and 11) extending from the other end 2*d* of the cylinder block 2. The vertical passages 11*a* to 11*d* are disposed extending vertically toward a bottom surface of the cylinder block 2 and formed by withdrawing a pin-like jig 42. The other verticall passages may be likewise formed. Like other jigs, the pin-like jigs 41 and 42 serve as so-called cores during casting the cylinder block 2 and withdrawn from the cylinder block 2 after the casting. The main oil gallery 10 is closed at its other end 10*b* with a lid (not shown).

Figure 4:
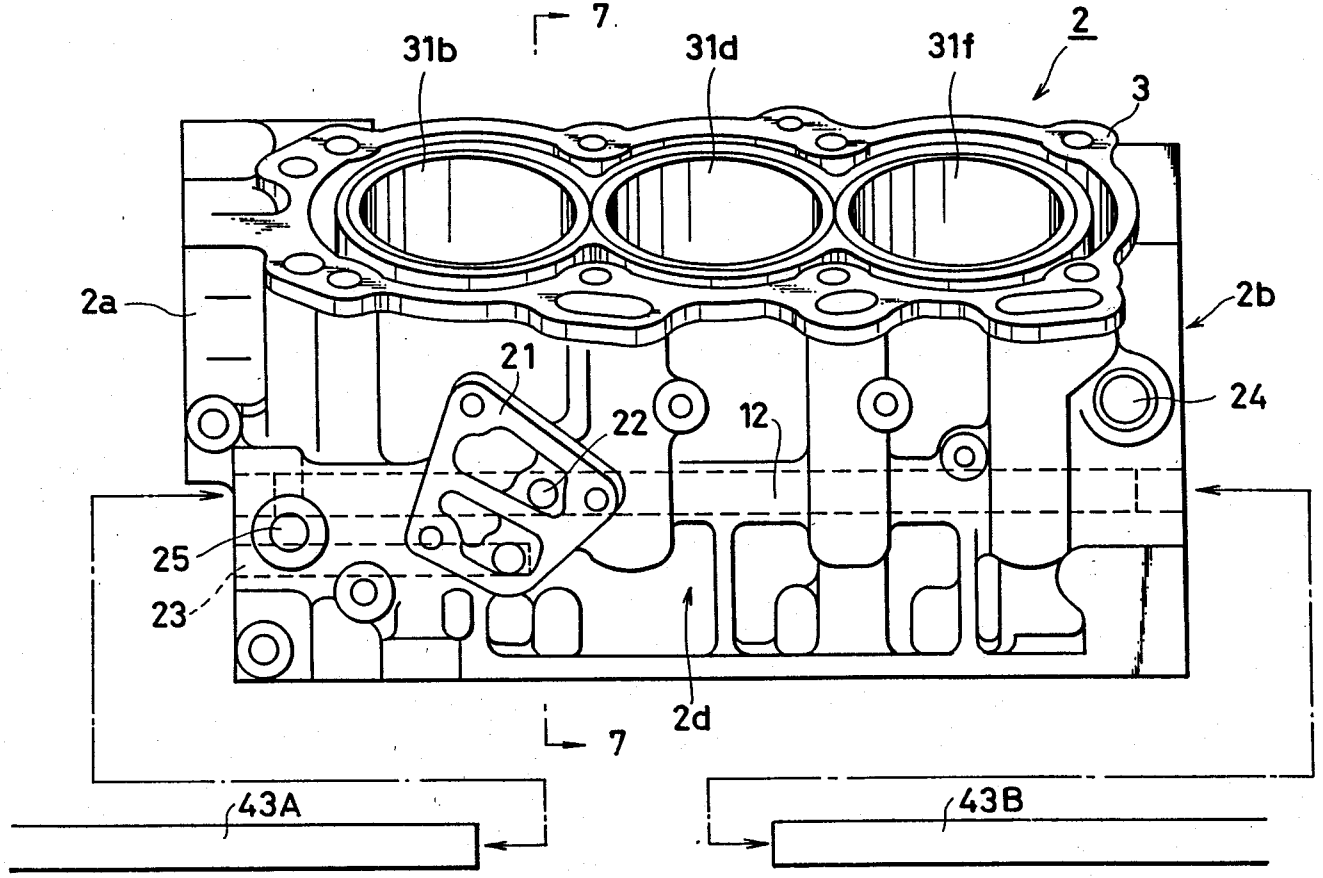
FIG. 4 is a side view showing the cylinder block.
Figure 5:
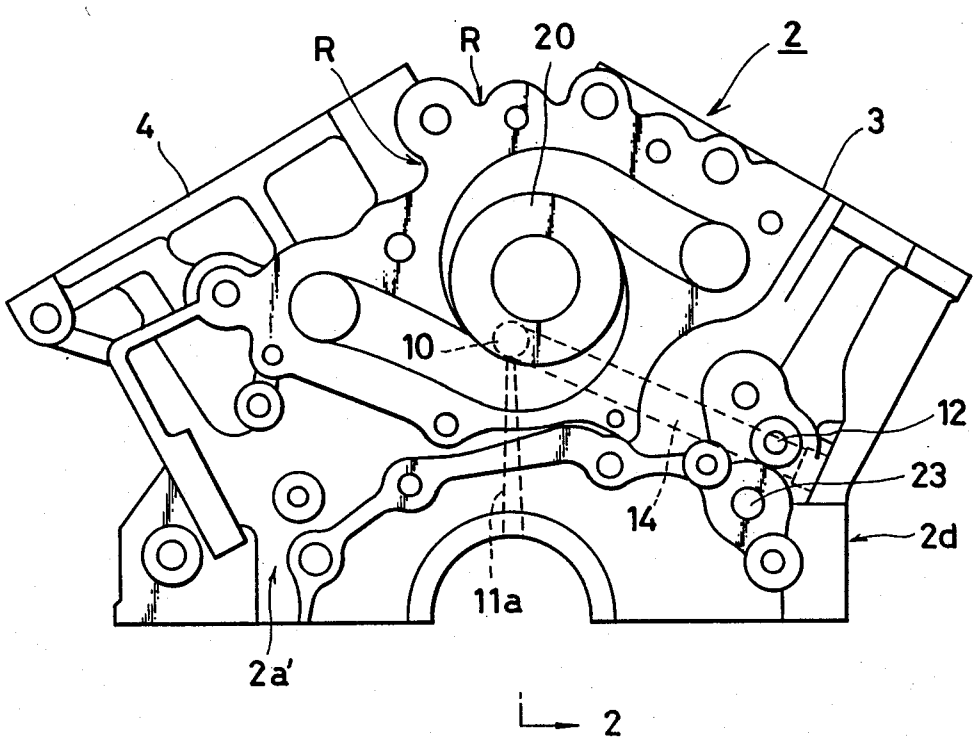
FIG. 5 is a plane view showing the cylinder block when looked at from one end side.
Figure 6:
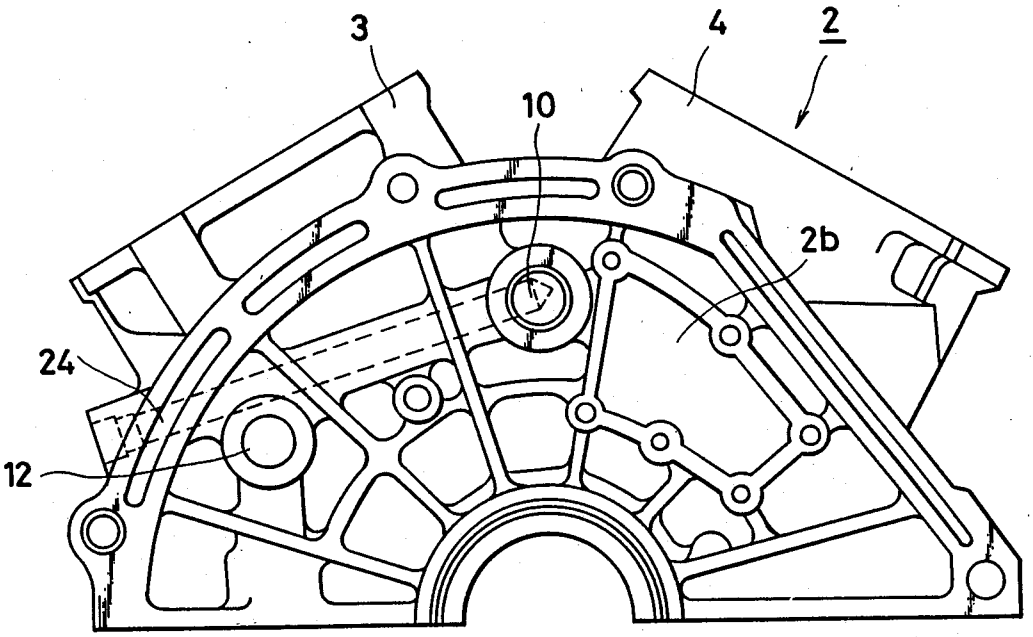
FIG. 6 is a plane view showing the cylinder block when looked at from the other end side.
Figure 7:
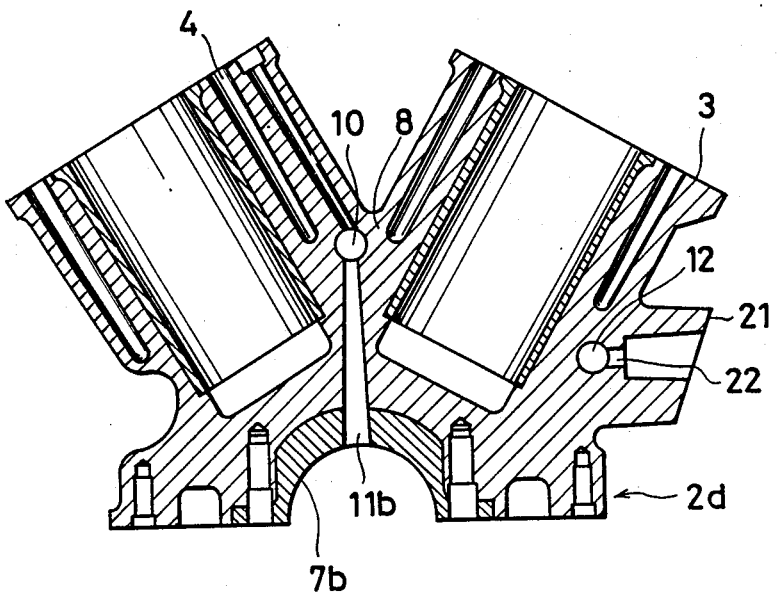
FIG. 7 is a cross-sectional view taken along the line X7—X7 of FIG. 4.
Figure 8:
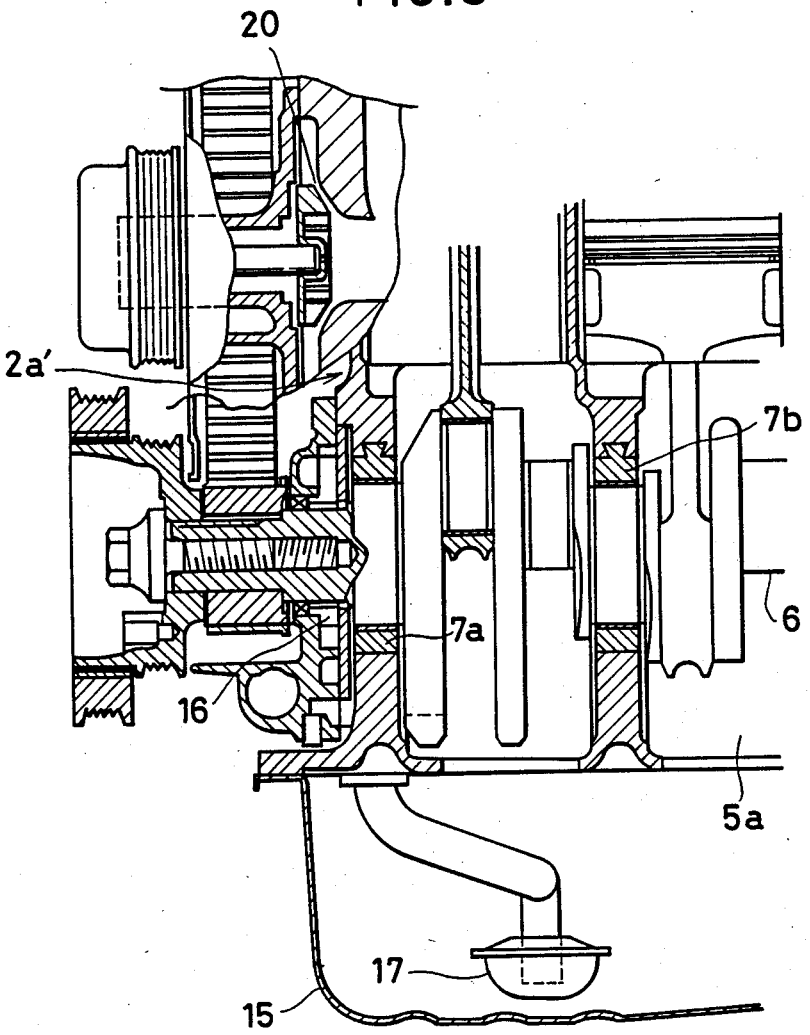
FIG. 8 is a cross-sectional view showing one side portion of the V-type engine.

As shown in FIG. 4, the subordinate oil gallery 12 is formed by the die-withdrawing method as a through hole extending in a lengthwise direction of the cylinder block 2. In this embodiment, in order to minimize a diameter of the subordinate oil gallery 12, it is formed using two pin-like jigs 43A and 43B disposed on the one side 2*a* and on the other side 2*b*, respectively, of the cylinder block 2. In FIG. 4, reference numeral 21 stands for a mounting seat for the oil filter 18, reference numeral 22 for an outlet passage from the oil filter 18 to the subordinate oil gallery 12, and reference numeral 23 for an inlet passage from the oil pump 16 to the oil filter 18. The outlet and inlet passages 22 and 23 constitute a linkage passage. The both passages 22 and 23 are formed using pin-like jigs (not shown in the drawings). In FIG. 4, reference numeral 24 denotes a hole for the linkage passage 13, through which the pin-like jig was withdrawn after the passage 22 has been formed, and reference numeral 25 denotes a hole for the feed passage 14, through which the jig was withdrawn after the passage 23 has been formed. Openings of the holes 24 and 25 are closed by lids (not shown).

As have been described hereinabove, lubricating oil is fed to the main oil gallery 10 through the feed passage 14 for the subordinate oil gallery 12, not from the main oil gallery 10, so that the main oil gallery 10 is not required to extend up to the one end portion 2*a* of the cylinder block 2. Accordingly, even if the water pump 20 is mounted at the center portion 8 of the cylinder block 2, it does not interfere with the main oil gallery 10. Thus the V-type engine 1 according to the present invention presents the great advantage that the water pump 20 can be disposed at the middle portion between the both banks 3 and 4 and at a low position. As the pump chamber of the water pump 20 is disposed at one end surface 2*a* of the cylinder block 2, it is extremely advantageous to shorten a whole length of the engine. This advantage is remarkable compared with a supply of lubricating oil to the crank journaling portions 7*b* and 7*c* through the bores from the subordinate oil gallery 12 connected to the main oil gallery 10 which is communicated with the feed passages 11*b* and 11*c*, respectively, for feeding lubricating oil. There is no spare space between the bores.

That the main oil gallery 10 is not required to extend over a full length of the cylinder block presents the advantage that the hole therefor can be formed using a pin-like jig having a small diameter when the cylinder block 2 is made from a light alloy as in this embodiment.

Figure 3:
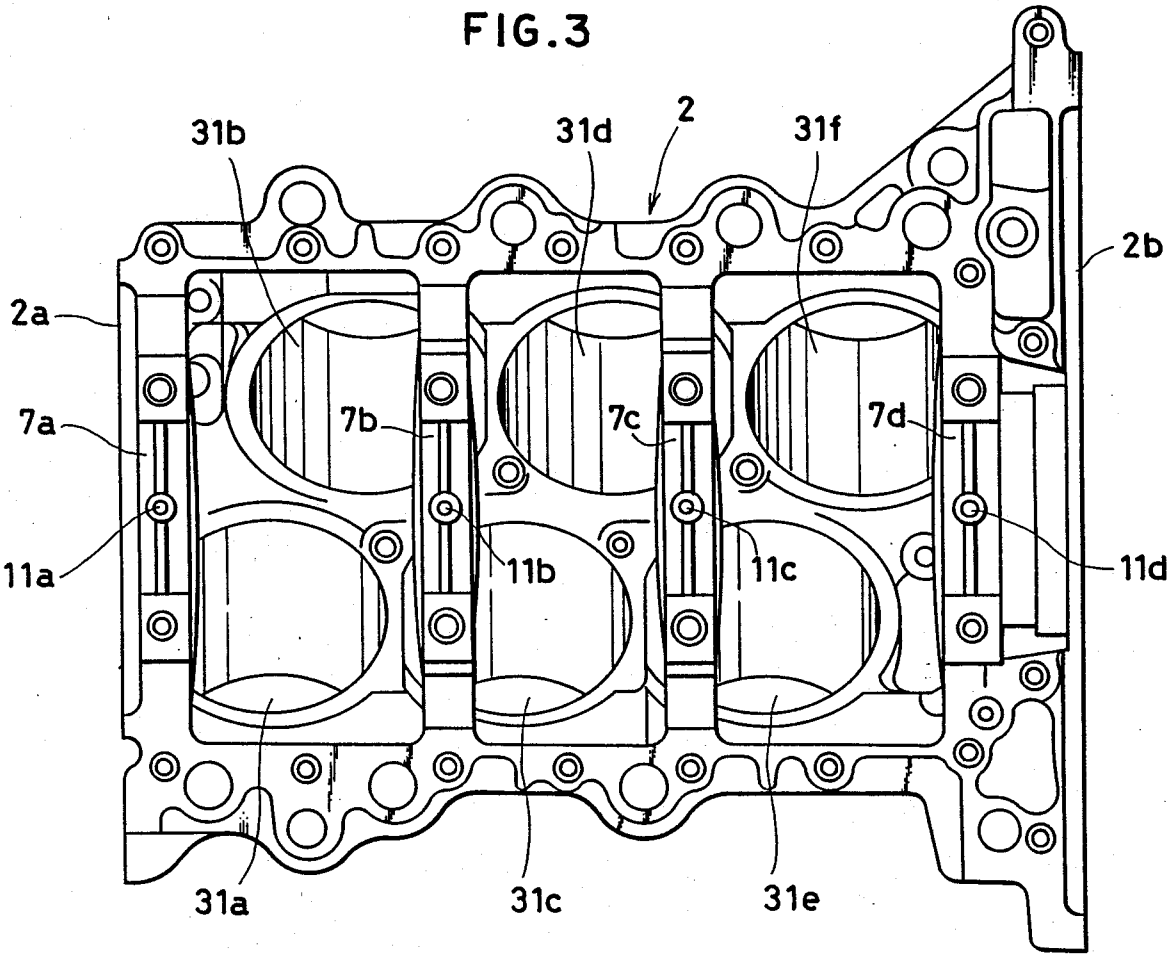
FIG. 3 is a bottom view showing the cylinder block.

Referring now to FIG. 3, it is shown that an axis of the cylinder bore 31*b* on the right-hand bank 3 is offset closer toward the side of the other end portion 2*b* of the cylinder block 2 in the axial direction of the crank shaft 6 than an axis of the cylinder bore 31*a* on the left-hand bank 4 in the axial direction thereof. Likewise, an axis of cylinder bore 31*d* on the right-hand bank 3 is offset closer toward the side of the other end portion 2*b* in the axial direction thereof than an axis of the cylinder bore 31*c* on the left-hand bank 4 while an axis of the cylinder bore 31*f* thereon is offset closer toward the other end portion 2*b* thereof in the axial direction thereof than an axis of the cylinder bore 31*e* thereon. The first feed passage constituted by the passages 11*a* and 14 is disposed in a vicinity of a side portion of the cylinder bore 31*a* closer to the one end portion 2*a* of the cylinder block 2 in the axial direction of the crank shaft 6. The linkage passage 13 interconnecting the main oil gallery 10 to the subordinate oil gallery 12 is disposed in a vicinity of a side portion of the cylinder bore 31*f* closer to the other end portion 2*b* in the axial direction thereof.

The crank journaling portions 7*a* to 7*d* are made from an irony alloy and cast with a light alloy as a base material during casting the cylinder block 2. The positions of the crank journaling portions 7*a* to 7*d* are accurately determined using the pin-like jig 42 during the casting.

Figure 9:
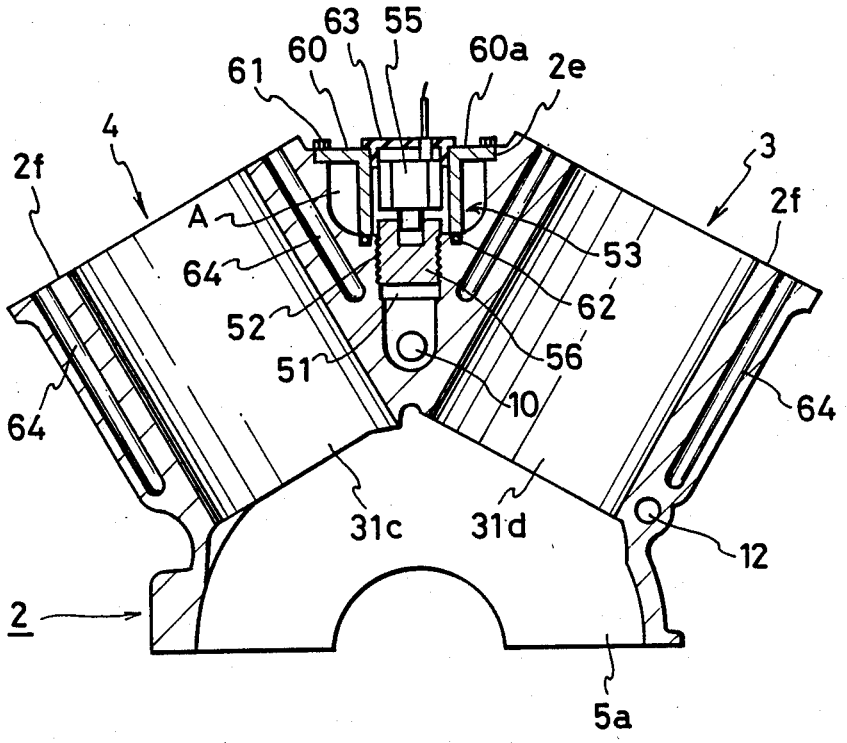
FIG. 9 is a cross-sectional view showing the structure of mounting a knock sensor, taken along the line X9—X9 of FIG. 10.
Figure 10:
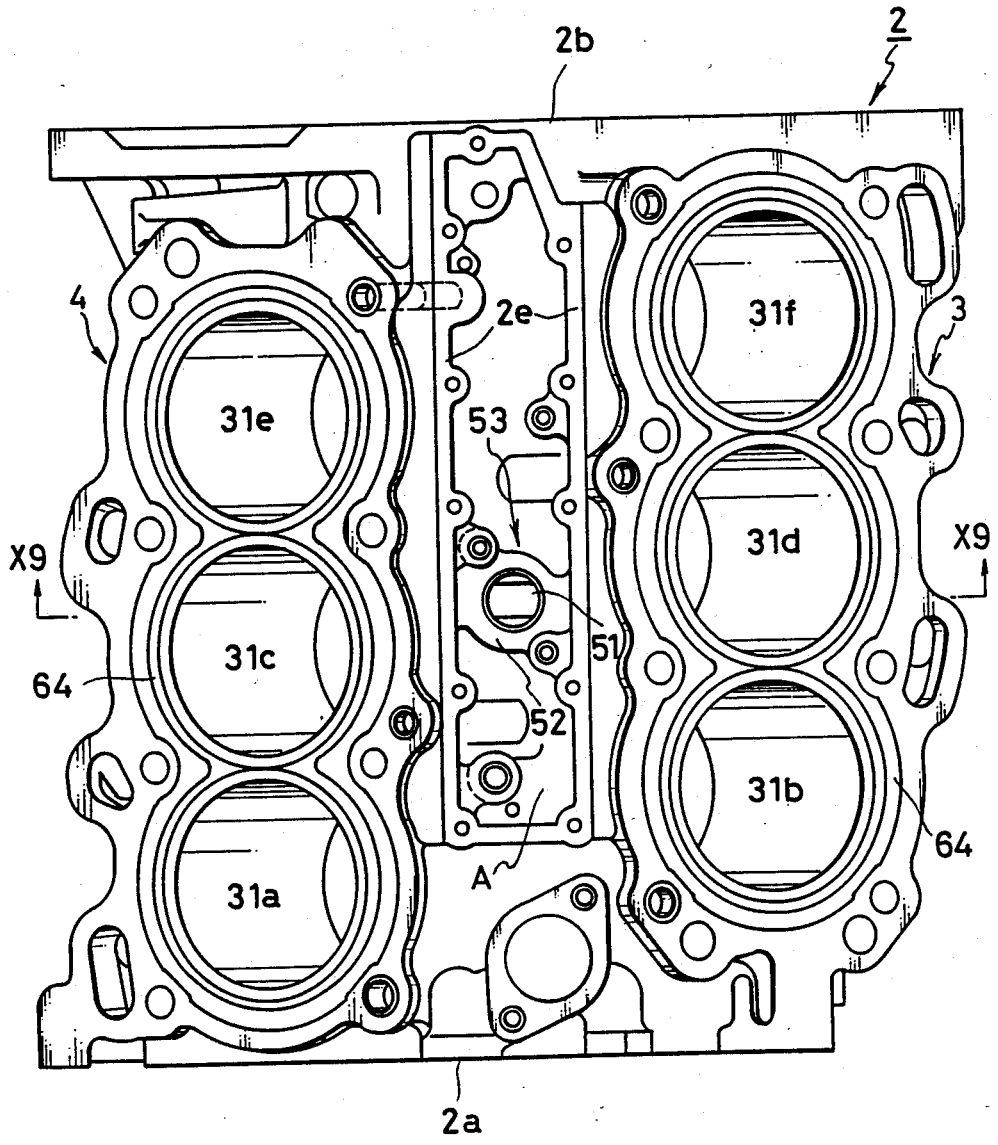
FIG. 10 is a plane view showing the mounting site of the knock sensor on the cylinder block.

The following is a description on detail of a site on which a knock sensor is mounted in conjunction with FIGS. 9 to 11.

The main oil gallery 10 is provided at its intermediate position with an insert bore 51 having an upward opening and the insert bore 51 is provided at its outer circumference with a boss portion 52 in a cylindrical form elongating upwardly, which serves as a mounting seat for a knock sensor 55.

A plug 56 is engaged with the insert bore 51, and the plug 56 closes the opening of the main oil gallery 10. The knock sensor 55 is mounted on the plug 56 for detecting a vibration (sound) transmitted to the plug 56.

As shown in FIG. 11, the main oil gallery 10 is formed as a die-withdrawing hole using a jig combination consisting of a pin-like jig 41 and a support jig 58 supporting the pin-like jig 41 from the upward. More specifically, the pin-like jig 41 is inserted from a transverse direction by mold clamping during the die casting and engaged at its tip portion with and by the support jig 58 supporting the pin-like jig 41 from the upward.

In such a mold clamped state that the pin-like jig 41 is engaged with the support jig 58, a molten metal liquor is poured into a cavity of a mold to cast the cylinder block 2. After cooling, the mold is opened by withdrawing the pin-like jig 41 toward the transverse direction to be disengaged from the support jig 58 which, in turn, is removed toward the upward.

As shown in FIG. 9, the boss portion 52 is formed continuously in the side walls of the right-hand and left-hand banks 3 and 4 so that it is high in toughness, and the engagement of the plug 56 with the boss portion 52 and the mounting of the knock sensor 55 are carried out in the manner as have been described hereinabove.

In a state in which the knock sensor 55 is mounted on the boss portion 52, a lid member 60 is mounted at an upper position between the banks 3 and 4 and disposed adjacent to the knock sensor 55. The lid member 60 comprises a ceiling plate portion 60*a* and a cylindrical portion 60*b* extending downwardly adjacent to a side wall portion of the knock sensor 55. The ceiling plate portion 60*a* of the lid member 60 is abutted with facing surfaces 2*e* of the right-hand and left-hand banks 3 and 4 and bolted thereto with bolts 61. At an upper portion of the cylindrical portion 60*b* is mounted a boot 63 to close a gap between the ceiling plate portion 60*a* and an outer circumferential portion of the knock sensor 55 and cover a top portion of the knock sensor 55, thereby preventing a penetration of water or other foreign materials through the gap therebetween. At a bottom end of the cylindrical portion 60*b* is mounted an O-ring 62 to be pressure welded to an upper surface portion of the cylinder block 2, thereby forming a sealed state.

A space formed underneath the lid member 60 between the banks 3 and 4 serves as a blow-by gas chamber A which, in turn, is used for a passage leading a blow-by gas generated in the crank chamber to an intake passage.

As the cylinder block 2 is formed by the die casting, a cooling water passage 64 (a water jacket) is likewise formed at an outer circumference of the cylinder bores 31 by the die-withdrawing processing. The water jacket 64 is formed of an open deck type in which an upper end of the water jacket 64 has opening on a deck surface 2*f* of the cylinder block 2. This structure enables a knocking vibration caused by knocking in the cylinder bores 31*a* to 31*f* to be detected by the knock sensor 55 from the main oil gallery 10. The knocking vibration is first transmitted downwardly through the wall portions of the cylinder bores 31*a* to 31*f* and then nearby the main oil gallery 10 in an axial direction of the crank shaft 6. The use of the cylinder block 2 of the open deck type permits a favorable detection of knocking because the vibration does not transmit along the deck surface 2*f*.

Furthermore, a cylinder head (not shown) is disposed above each of the banks 3 and 4 and an intake manifold for supplying intake air to each cylinder mounted in the banks 3 and 4 is mounted at a position over the lid member 60 between the banks 3 and 4.

The present invention has been described by way of one example, but it is to be understood that a linkage passage 13 interconnecting the main oil gallery 10 to the subordinate oil gallery 12 is disposed in the cylinder block 2 may be disposed using an exterior pipe.

The present invention may be embodied in other specific forms without departing from the spirit and scope thereof. The present embodiments as have been described hereinabove are therefore to be considered in all respects as illustrative and not restrictive, the scope of the invention being indicated by the appended claims, and all the changes and modifications which come within the meaning and range of equivalency of the claims are therefore intended to be encompassed within the spirit and scope of the invention.

What is claimed is:

1. In a V-type engine in which a cylinder block comprises a left-hand bank and a right-hand bank, said left-hand and right-hand banks being arranged in a V-shaped form and having each a cylinder bore, and a crank chamber on which a lower end of each cylinder bore has opening; and in which a crank shaft mounted in said crank chamber is rotatably supported by plural crank journaling portions arranged in said cylinder block in a spaced relationship in an axial direction of the crank shaft; a V-type engine wherein:

said cylinder block includes a main oil gallery elongating in the axial direction of said crank shaft; a subordinate oil gallery elongating in said axial direction; a first feed passage feeding oil from said subordinate oil gallery to a predetermined crank journaling portion disposed at least on a side of one end portion of said cylinder block disposed in said axial direction, among said plural crank journaling portions, without passing through said main oil gallery; a second feed passage feeding a lubricating oil from said main oil gallery to said crank journaling portions other than said predetermined crank journaling portion; and a pump chamber having a rotary shaft disposed in parallel to said crank shaft;

a linkage passage interconnecting said main oil gallery to aid subordinate oil gallery;

said main oil gallery is disposed in a middle portion between said banks and at a position above said crank chamber, a top end of said main oil gallery being in a length elongating in said axial direction so as to fail to reach said predetermined crank journaling portion;

said subordinate oil gallery is disposed on one outward side portions of said banks; and said pump chamber is disposed at one end portion of said cylinder block in said axial direction and on an imaginary line extending from said main oil gallery.

2. A V-type engine as claimed in claim 1, wherein:

an axis of a first cylinder bore disposed in one of said banks is offset closer toward the other end portion of said cylinder block in said axial direction than an axis of a second cylinder bore disposed in the other bank;

said subordinate oil gallery is disposed at a position above a lower end of said first cylinder bore in an axial direction of said first cylinder bore;

said first feed passage is disposed in a vicinity of one end side of the cylinder bore disposed on the one end side in said axial direction; and said linkage passage is disposed in a vicinity of the other end side of the cylinder bore disposed on the other end side in said axial direction.

3. A V-type engine as claimed in claim 2, wherein:

an oil filter is disposed on one outward side portion of said cylinder block of said bank;

said oil filter is disposed at an intermediate portion of a linkage passage interconnecting an oil pump to said subordinate oil gallery; and said pump chamber comprises a water pump chamber disposed at a position above said oil pump.

4. A V-type engine as claimed in claim 3, wherein:

a mounting seat for mounting said oil filter is disposed on one outward side surfaces of said banks;

said cylinder block includes an inlet passage for said linkage passage and on outlet passage therefor, said inlet passage leading oil fed from said oil pump to said oil filter mounted on said mounting seat and said outlet passage leading oil withdrawn from said oil filter to said subordinate oil gallery; and said inlet passage is disposed on one outward side portions of said banks and at a position below said subordinate oil gallery.

5. A V-type engine as claimed in claim 3, comprising:

said cylinder block formed by casting;

said main oil gallery formed as a die-withdrawing hole by withdrawing a pin-like jig from said cylinder block;

a boss portion formed on said cylinder block in a shape corresponding to a support jig supporting said pin-like jig from outward during casting; and a mounting seat disposed on said boss portion for mounting a knock sensor.

6. A V-type engine as claimed in claim 1, comprising:

said cylinder block formed by casting using a light alloy;

said main oil gallery formed as a die-withdrawing hole in a shape corresponding to a pin-like jig to be withdrawn from other side surface of said cylinder block in an axial direction of the crank shaft;

said pump chamber formed having opening on a side of one side surface of said cylinder block in said axial direction; and a boss portion formed on said cylinder block in a shape corresponding to a support jig supporting said pin-like jig from outward during casting, said boss portion disposed at an intermediate position in said axial direction and at a position above said main oil gallery.

7. A V-type engine as claimed in claim 6, wherein:

a portion of said first feed passage on the side of said predetermined crank journaling portion constitutes a vertical passage elongating in a vertical direction; and a portion of at least one of said vertical passage and said second feed passage on the side of said predetermined crank journaling portion is formed as a die-withdrawing hole in a shape corresponding to a pin-like jig to be withdrawn from downward.

8. A V-type engine as claimed in claim 6, wherein:

said boss portion is disposed at a substantially middle portion of said cylinder block in said axial direction; and said boss portion is provided with a mounting seat for mounting a knock sensor.

9. A V-type engine as claimed in claim 7, wherein:

said vertical passage extends in a substantially vertical direction with respect to a bottom surface of said cylinder block;

said second feed passage extends in a substantially vertical direction with respect to a bottom surface of said cylinder block; and said crank journaling portion is made from an irony alloy and said irony alloy is cast by a light alloy as a base material.

10. A V-type engine as claimed in claim 7, wherein:

an axis of a first cylinder bore disposed in one of said banks is offset closer toward the other end portion of said cylinder block in said axial direction than an axis of a second cylinder bore disposed in the other bank;

said subordinate oil gallery is disposed at a position above a lower end of said first cylinder bore in an axial direction of said first cylinder bore;

said first feed passage is disposed in a vicinity of one end side of the cylinder bore disposed on the one end side in said axial direction; and said linkage passage is disposed in a vicinity of other end side of the cylinder bore disposed on the other end side in said axial direction.

11. A V-type engine as claimed in claim 10, wherein:

an oil filter is disposed on one outward side portion of said cylinder block of said bank;

said oil filter is disposed at an intermediate portion of a linkage passage interconnecting an oil pump to said subordinate oil gallery;

said pump chamber comprises a water pump chamber disposed at a position above said oil pump;

a mounting seat for mounting said oil filter is disposed on one outward side surfaces of said banks;

said cylinder block includes an inlet passage for said linkage passage and an outlet passage therefor, said inlet passage leading oil fed from said oil pump to said oil filter mounted on aid mounting seat and said outlet passage leading oil withdrawn from sail oil filter to said subordinate oil gallery; and said inlet passage is disposed on one outward side portions of said banks and at a position below said subordinate oil gallery.

12. A V-type engine as claimed in claim 11, wherein:

said boss portion is disposed at a substantially middle portion of said cylinder block in said axial direction; and said boss portion is provided with a mounting seat for mounting a knock sensor.

13. A V-type engine as claimed in claim 11, wherein:

said boss portion is provided with a mounting seat for mounting a knock sensor;

a lid member is mounted in a middle space present in a V-shaped form between said banks;

a closed space introducing a blow-by gas is defined in association of said lid member with an outer wall of said cylinder block; and said lid member is provided with a through hole for inserting a knock sensor toward said mounting seat disposed on said boss portion.

14. In a V-type engine in which a cylinder block comprises a left-hand bank and a right-hand bank, said left-hand and right-hand banks being arranged in a V-shaped form and having each a cylinder bore, and a crank chamber on which a lower end of each cylinder bore has opening; and in which a crank shaft mounted in said crank chamber is rotatably supported by plural crank journaling portions arranged in said cylinder block in a spaced relationship in an axial direction of the crank shaft; a V-type engine wherein:

said cylinder block is formed by casting: said cylinder block is provided with a die-withdrawing hole extending in said axial direction is formed at a position disposed between said banks;

a boss portion formed on said cylinder block in a shape corresponding to a support jig supporting said pin-like jig for said die-withdrawing hole from outward during casting; and a mounting seat disposed on said boss portion for mounting a knock sensor.

15. A V-type engine as claimed in claim 14, wherein:

said cylinder block is made from a light alloy; and said boss portion is disposed at a substantially intermediate portion of the cylinder block in said axial direction.

16. A V-type engine as claimed in claim 15, wherein:

said cylinder block includes a main oil gallery elongating in the axial direction of said crank shaft; a subordinate oil gallery elongating in said axial direction; a linkage passage interconnecting said main oil gallery to said subordinate oil gallery; a first feed passage feeding oil from said subordinate oil gallery to a predetermined crank journaling portion disposed at least on a side of one end portion of said cylinder block disposed in said axial direction, among said plural crank journaling portions, without passing through said main oil gallery; a second feed passage feeding a lubricating oil from said main oil gallery to said crank journaling portions other than said predetermined crank journaling portion; and a pump chamber having a rotary shaft disposed in parallel to said crank shaft;

said main oil gallery is formed as a die-withdrawing hole in a shape corresponding to said pin-like jig, disposed in a middle portion between said banks and at a position above said crank chamber, a top end of said main oil gallery being in a length elongating in said axial direction thereof so as to fail to reach said predetermined crank journaling portion;

said subordinate oil gallery is disposed on one outward side portions of said banks; and said pump chamber is disposed at one end portion of said cylinder block in said axial direction thereof and on an imaginary line extending from said main oil gallery.

17. A V-type engine as claimed in claim 14, wherein:

an axis of a first cylinder bore disposed in one of said banks is offset closer toward the other end portion of said cylinder block in said axial direction than an axis of a second cylinder bore disposed in the other bank;

said subordinate oil gallery is disposed at a position above a lower end of said first cylinder bore in an axial direction of said first cylinder bore;

said first feed passage is disposed in a vicinity of one end side of the cylinder bore disposed on the one end side in said axial direction;

said linkage passage is disposed in a vicinity of other end side of the cylinder bore disposed on the other end side in said axial direction;

an oil filter is disposed on one outward side portion of said cylinder block of said bank;

said oil filter is disposed at an intermediate portion of a linkage passage interconnecting an oil pump to said subordinate oil gallery; and said pump chamber comprises a water pump chamber disposed at a position above said oil pump.

18. A V-type engine as claimed in claim 17, wherein:

said cylinder block formed by casting using a light alloy;

said main oil gallery formed as a die-withdrawing hole in a shape corresponding to a pin-like jig to be withdrawn from other side surface of said cylinder block in an axial direction of the crank shaft;

said pump chamber formed having opening on a side of one side surface of said cylinder block in said axial direction;

a boss portion formed on said cylinder block in a shape corresponding to a support jig supporting said pin-like jig from outward during casting, said boss portion disposed at an intermediate position in said axial direction and at a position above said main oil gallery;

a portion of said first feed passage on the side of said predetermined crank journaling portion constitutes a vertical passage elongating in a vertical direction; and a portion of at least one of said vertical passage and said second feed passage on the side of said predetermined crank journaling portion is formed as a die-withdrawing hole in a shape corresponding to a pin-like jig to be withdrawn from downward.

19. A V-type engine as claimed in claim 18, wherein:

said vertical passage extends in a substantially vertical direction with respect to a bottom surface of said cylinder block;

said second feed passage extends in a substantially vertical direction with respect to a bottom surface of said cylinder block; and said crank journaling portion is made from an irony alloy and said irony alloy is cast by a light alloy as a base material.

* * * * *